United States Patent [19]

Lenz

[11] Patent Number: 4,767,364

[45] Date of Patent: Aug. 30, 1988

[54] ADVANCED STEERING AND PROPULSION SYSTEM FOR SHIPS

[76] Inventor: Erwin Lenz, 180 Cabrini Blvd., Apt. 114, New York, N.Y. 10033

[21] Appl. No.: 3,364

[22] Filed: Jan. 14, 1987

[51] Int. Cl.[4] ..... B63H 11/00

[52] U.S. Cl. ..... 440/38; 440/44; 114/151; 60/221

[58] Field of Search ..... 114/184, 270, 151; 440/38, 40, 44, 47; 60/221, 222

[56] References Cited

U.S. PATENT DOCUMENTS

| | | | |
|---|---|---|---|
| 138,665 | 5/1873 | Leggo | 440/44 |
| 1,229,729 | 6/1917 | Edinger | 440/44 |
| 1,259,753 | 3/1918 | Lassell | 440/44 |
| 2,993,462 | 7/1961 | Gough | 440/44 |
| 3,079,751 | 3/1963 | Lewis | 440/44 |
| 3,273,333 | 9/1966 | Roulund | 114/184 |

FOREIGN PATENT DOCUMENTS

| | | | |
|---|---|---|---|
| 283338 | 1/1928 | United Kingdom | 440/44 |

*Primary Examiner*—Joseph F. Peters, Jr.
*Assistant Examiner*—Stephen P. Avila

[57] ABSTRACT

A steering and propulsion system for a ship, including two side by side, fore and aft pipes underneath a ship's hull, and compressed air or steam delivered through tubes around an exterior of the hull to the two pipes, and controls to eject forwardly or rearwardly out from the pipes.

3 Claims, 1 Drawing Sheet

ADVANCED STEERING AND PROPULSION SYSTEM FOR SHIPS

BACKGROUND OF THE INVENTION

1. Field of the Invention

This invention relates generally to marine propulsion systems. More specifically it relates to such systems used particularly for large and long vessels where there is a considerable distance between a bow and a stern thereof.

2. Prior Art

Numerous systems have been developed in the past for propulsion of modern ships, however they all have the limitation of having water penetrate through the ship's hull between an inboard power system that drives outboard propeller assemblies so that these prior art systems always have a problem with water seepage into the vessel especially at underwater bearings of moving drive shafts. Additionally, engine vibrations and drive shaft forces threatens, in time, all joints therebetween passing through the hull. These limitations exist even in water jet tunnelled ships that have been developed, as is evident in U.S. Pat. No. 2,993,462 to Gough, U.S. Pat. No. 3,079,751 to Lewis and U.S. Pat. No. 3,273,333 to Roulund.

SUMMARY OF THE INVENTION

Accordingly it is a principal object of the present invention to provide a ship propulsion system wherein a jet tunnel is located externally of a ship's hull to overcome the above indicated limitation, and which is more silent.

Another object is to provide a propulsion system which is powered by compressed air or steam so that energy is converted directly into motion without transmission gears, chains or belts, and also wherein a ship does not require a steering rudder which in conventional ships is a hindrance from using all the produced energy to move the ship ahead.

Yet another object is to provide a ship steering and propulsion system which accordingly produces greater speed while less energy is consumed.

Yet another important object is to provide a ship steering and propulsion system which unlike conventional exposed propellers, does not damage the environment by killing fish and sea mammals such as seals, manatees, whales and the like.

Further objects of the invention will appear as the description proceeds.

To the accomplishment of the above and related objects, this invention may be embodied in the form illustrated in the accompanying drawings, attention being called to the fact, however, that the drawings are illustrative only and that may be made in the specific construction illustrated and described within the scope of the appended claims.

BRIEF DESCRIPTION OF THE DRAWINGS FIGURES

The figures in the drawings are briefly described as follows:

FIG. 1 is a top plan view with parts of a typical ship broken away illustrating the invention incorporated there on.

FIG. 2 is a side elevational view thereof.

FIG. 3 is a rear end view of thereof.

FIG. 4 is an enlarged cross sectional view of one of the injector housings.

FIG. 5 is an enlarged cross sectional view of the front end of one of the water ducts.

DETAILED DESCRIPTION OF PREFERRED EMBODIMENT

Figures 1, 2, 3, 4, 5:
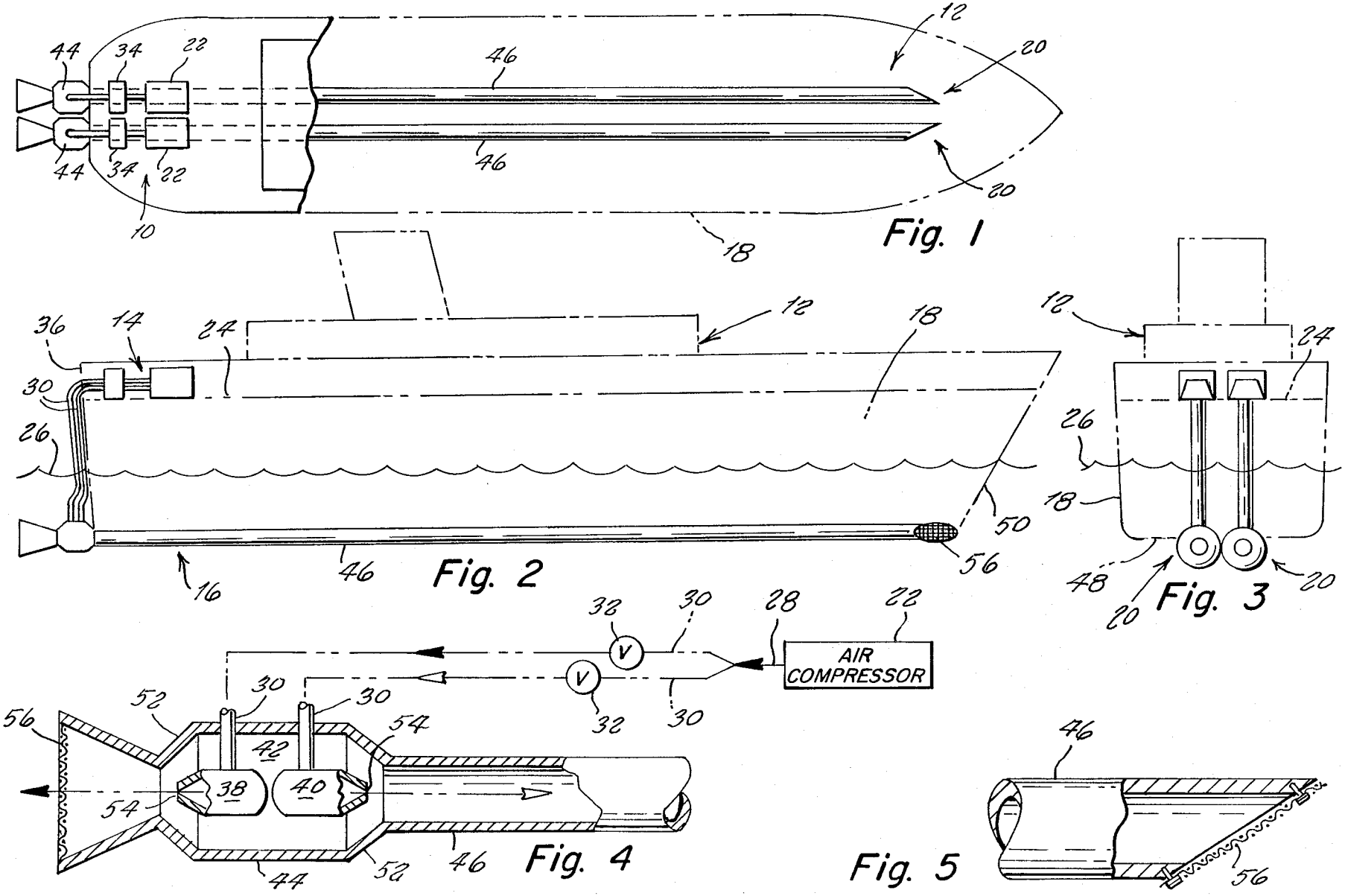

Referring now to the Drawing in greater detail, the reference numeral 10 represents an advanced steering and propulsion system for a ship 12 wherein the same includes an inboard power producing unit 14 and a ship driving unit 16 that is located externally of the ship's hull 18 without any connection passing therethrough.

The system 10 is comprised of two side by side similar assemblies 20 each one of which includes a unit 14 and a unit 16.

The power unit 14 includes an air compressors 22 or alternatively steam engines which are located on any under-deck 24 that is higher than sea level 26. Compressed air or alternatively steam respectively is delivered from the compressor or engine through a pipe 28 to a pair of branch lines 30, each of which is intercepted by a valve station 34 where unit 20 may be selectively controlled from the ship's bridge or by a helmsman for controlling the ship speed and direction. Each of the branch lines extends externally around a stern 36 of the hull and one of the branch lines communicates with a rearwardly directed injector 38 and the other branch line communicates with a forwardly directed injector 40. Both of the injectors are contained within a single chamber 42 of an enlarged housing 44 that is located near a rear end of a wide diameter pipe 46 rigidly affixed to an exterior underside 48 of the hull and positioned to extend under the full length of the keel which extends from the bow 50 to the stern. The chamber 42 communicates with the pipe interior so to form a passage for compressed air or steam to run therethrough in either direction. Opposite ends of the housing 44 taper to form venturi 52 into which the injector jets 54 are directed. A rear end of the pipe 46 is flared and, similarly to a forward end thereof, is covered by a screen 56 to keep sea life and debris from entering the pipe passage.

In use, it is now evident that by controlling the valves of both assemblies, 20 the ship can be turned without a rudder.

The injectors 38 moves the vessel forward and injectors 40 rearward. When moving ahead, environmental water is taken in at the ship's bow at a point where its resistance to forward motion is greatest and is then ejected with the air or steam at the rear where pressure is lowest behind the moving ship.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A steering and propulsion system for ships comprising, in combination, a pair of side-by-side assemblies, each said assembly comprising an inboard power producing unit, an exterior ship driving unit and fluid flow connecting means therebetween;

each of said power-producing units comprising a fluid flow producing means designed to produce a pressurized fluid;

each of said ship driving units comprising a pipe mounted adjacent an exterior underside of said hull and extending from a bow to a stern of said hull, the ends of the pipe being open; an enlarged housing means secured to the stern end of said pipe, the housing defining an internal chamber open to fluid-flow connection at a front end with the stern of the pipe and at a rear end with the environment, the chamber having a double taper, such that the internal diameter of the chamber is the smallest at the two ends so as to form a venturi at each end, a central portion of the chamber intermediate the two venturi having a substantially constant internal diameter; and a pair of injector nozzles within the chamber, in back-to-back relationship, such that one nozzle opening faces forwardly and the second nozzle opening faces rearwardly, each nozzle opening facing directly into the venturi at the respective end of the chamber, such that any fluid passing out from the nozzle is injected substantially directly into a venturi;

the fluid-flow connecting means comprising a pair of tubes, each tube extending at one end into the housing and being in fluid-flow connection at that end to a nozzle and at the second end in fluid-flow connection to the power-producing unit; and valve means located intermediate the power-producing means and each nozzle to alternately permit or close off fluid flow into such nozzle, the fluid-flow connecting tubes extending above and around the stern end of the hull of the ship.

2. The combination as set forth in claim 1, wherein said pressure producing means comprises an air compressor.

3. The combination as set forth in claim 1 wherein said power producing means comprises a steam engine.

* * * * *